US009978379B2

(12) United States Patent
Vilermo et al.

(10) Patent No.: US 9,978,379 B2
(45) Date of Patent: May 22, 2018

(54) MULTI-CHANNEL ENCODING AND/OR DECODING USING NON-NEGATIVE TENSOR FACTORIZATION

(75) Inventors: Miikka Vilermo, Siuro (FI); Joonas Nikunen, Tampere (FI); Tuomas Virtanen, Tampere (FI)

(73) Assignee: Nokia Technologies Oy, Espoo (FI)

( * ) Notice: Subject to any disclaimer, the term of this patent is extended or adjusted under 35 U.S.C. 154(b) by 671 days.

(21) Appl. No.: 13/977,230

(22) PCT Filed: Jan. 5, 2011

(86) PCT No.: PCT/IB2011/050042

§ 371 (c)(1),
(2), (4) Date: Jun. 28, 2013

(87) PCT Pub. No.: WO2012/093290

PCT Pub. Date: Jul. 12, 2012

(65) Prior Publication Data

US 2013/0282386 A1 Oct. 24, 2013

(51) Int. Cl.

| | |
|---|---|
| ***G10L 19/008*** | (2013.01) |
| ***G10L 19/083*** | (2013.01) |
| ***G10L 19/06*** | (2013.01) |

(52) U.S. Cl.

CPC ..... *G10L 19/008* (2013.01); *G10L 19/06* (2013.01); *G10L 19/083* (2013.01)

(58) Field of Classification Search

CPC ..... G10L 19/00; G10L 19/008; G10L 19/083
USPC ..... 704/200.1, 201, 206, 500, E19.005; 381/23

See application file for complete search history.

(56) References Cited

U.S. PATENT DOCUMENTS

| | | | | |
|---|---|---|---|---|
| 5,579,430 | A * | 11/1996 | Grill et al. | 704/203 |
| 5,651,090 | A * | 7/1997 | Moriya et al. | 704/200.1 |
| 5,890,125 | A | 3/1999 | Davis et al. | |
| 5,991,725 | A * | 11/1999 | Asghar et al. | 704/270 |
| 6,038,536 | A * | 3/2000 | Haroun et al. | 704/500 |
| 6,606,600 | B1 * | 8/2003 | Murgia et al. | 704/500 |
| 7,861,131 | B1 * | 12/2010 | Xu | H03M 13/2909 714/752 |
| 8,332,216 | B2 * | 12/2012 | Kurniawati et al. | 704/229 |
| 8,817,991 | B2 * | 8/2014 | Jaillet et al. | 381/22 |
| 2004/0044524 | A1 * | 3/2004 | Minde et al. | 704/220 |
| 2004/0101048 | A1 * | 5/2004 | Paris | 375/240.12 |
| 2007/0016406 | A1 | 1/2007 | Thumpudi et al. | |
| 2007/0238415 | A1 * | 10/2007 | Sinha | G10L 19/0208 455/66.1 |

(Continued)

FOREIGN PATENT DOCUMENTS

| | | |
|---|---|---|
| EP | 0878798 | 11/1998 |

OTHER PUBLICATIONS

Fitzgerald, et al. "Non-negative tensor factorisation for sound source separation." Proceedings of the Irish Signals and Systems Conference, Dublin, Ireland, Sep. 2005, pp. 1-5.*

(Continued)

*Primary Examiner* — James Wozniak
(74) *Attorney, Agent, or Firm* — Alston & Bird LLP

(57) ABSTRACT

A method comprising: receiving input signals for multiple channels; and parameterizing the received input signals into parameters defining multiple different object spectra and defining a distribution of the multiple different object spectra in the multiple channels.

10 Claims, 4 Drawing Sheets

(56) References Cited

U.S. PATENT DOCUMENTS

| | | | | |
|---|---|---|---|---|
| 2007/0271095 | A1 | 11/2007 | Miyasaka et al. | |
| 2008/0033731 | A1* | 2/2008 | Vinton et al. | 704/500 |
| 2008/0049943 | A1* | 2/2008 | Faller et al. | 381/17 |
| 2008/0255832 | A1* | 10/2008 | Goto et al. | 704/219 |
| 2009/0182564 | A1* | 7/2009 | Beack et al. | 704/500 |
| 2009/0248425 | A1 | 10/2009 | Vetterli et al. | |
| 2010/0169101 | A1* | 7/2010 | Ashley et al. | 704/500 |
| 2010/0198601 | A1 | 8/2010 | Mouhssine et al. | |
| 2010/0232619 | A1* | 9/2010 | Uhle et al. | 381/80 |
| 2010/0322429 | A1* | 12/2010 | Norvell et al. | 381/22 |
| 2011/0029310 | A1* | 2/2011 | Jung et al. | 704/233 |
| 2011/0040556 | A1* | 2/2011 | Moon | G10L 19/008 704/205 |
| 2011/0194709 | A1* | 8/2011 | Ozerov | G10L 21/0272 381/119 |

OTHER PUBLICATIONS

Ozerov, et al. "Multichannel nonnegative matrix factorization in convolutive mixtures. With application to blind audio source separation." IEEE Trans. AUdio, Speech Language Processing, Jan. 2009, pp. 1-13.*

Plumbley, Mark D., et al. "Sparse representations in audio and music: from coding to source separation." Proceedings of the IEEE 98.6, Nov. 2009, pp. 995-1005.*

Disch, Sascha, et al. "Using Transient Suppression in Blind Multi-Channel Upmix Algorithms." Audio Engineering Society Convention 122. Audio Engineering Society, May 2007, pp. 1-10.*

FitzGerald, Derry, et al. "Extended nonnegative tensor factorisation models for musical sound source separation." Computational Intelligence and Neuroscience, Apr. 2008, pp. 1-12.*

Cemgil, Ali et al. "Probabilistic latent tensor factorization framework for audio modeling." Applications of Signal Processing to Audio and Acoustics (WASPAA), 2011 IEEE Workshop on. IEEE, Oct. 2011, pp. 1-4.*

Herre et al., "MPEG Surround—The ISO/MPEG Standard forEfficient and Compatible MultichannelAudio Coding", Journal of the Audio Engineering Society, vol. 56, Issue No. 11, Nov. 2008, pp. 932-955.

Herre et al., "An Introduction to MP3 Surround", Fraunhofer Institute for Integrated Circuits IIS, 2005, pp. 1-9.

Nikunen et al., "Noise-to-Mask Ratio Minimization by Weighted Non-negative Matrix factorization", IEEE International Conference on Acoustics Speech and Signal Processing, Mar. 14-19, 2010, 4 pages.

Fitzgerald et al., "Non-Negative Tensor Factorisation for Sound Source Separation", In Proceedings of the Irish Signals and Systems Conference, Sep. 1-2, 2005, 5 pages.

Lee et al., "Algorithms for Non-negative Matrix Factorization", Advances in Neural Information Processing, vol. 13, 2001, 7 pages.

Virtanen, "Monaural Sound Source Separation by Nonnegative Matrix Factorization With Temporal Continuity and Sparseness Criteria", IEEE Transactions on Audio, Speech, and Language Processing, vol. 15, Issue 3, Mar. 2007, pp. 1066-1074.

Thiede et al., "PEAQ—The ITU Standard for Objective Measurement of Perceived Audio Quality", Journal of the Audio Engineering Society, vol. 48, Issue No. 1/2, Feb. 2000, pp. 3-29.

"Digital Audio Compression Standard (AC-3, E-AC-3)", Advanced Television Systems Committee Inc., Document A/52, Nov. 22, 2010, pp. 1-256.

Baumgarte et al., "Binaural Cue Coding—Part I: Psychoacoustic Fundamentals and Design Principles", IEEE Transactions on Speech and Audio Processing, vol. 11, Issue: 6, Nov. 2003, pp. 509-519.

Faller et al., "Binaural Cue Coding—Part II: Schemes and Applications", IEEE Transactions on Speech and Audio Processing, vol. 11, No. 6, Nov. 2003, pp. 520-531.

Extended European Search Report received for corresponding European Patent Application No. 11855192.8, dated Jun. 25, 2014, 11 pages.

Fitzgerald et al., "Extended Nonnegative Tensor Factorisation Models for Musical Sound Source Separation", Computational Inteligence and Neuroscience, vol. 2008, Jan. 1, 2008, 16 pages.

Grady et al., "Discovering Speech Phones Using Convolutive Non-negative Matrix Factorisation with a Sparseness Constraint", Neurocomputing, vol. 72, Jan. 16, 2008, pp. 1-26.

Wu et al., "Robust Feature Extraction for Speaker Recognition Based on Constrained Nonnegative Tensor Factorization", Journal of Computer Science and Technology, Jul. 2010, pp. 745-754.

Nikunen et al., "Multichannel audio upmixing based on non-negative tensor factorization representation", IEEE Workshop on Applications of Signal Processing to Audio and Acoustics, Oct. 16-19, 2011, 4 pages.

Goodwin et al. "Multichannel Matching Pursuit and Applications to Spatial Audio Coding", IEEE Singals, Systems and Computers, 2006. ACSSC '06 Fortieth Asilomar Conference on Oct. 29, 2006-Nov. 1, 2006, Pacific Grove, CA. pp. 1114-1118.

Tzagkarakis et al. "A Multichannel Sinusoidal Model Applied to Spot Microphone Signals for Immersive Audio" Audio, Speech and Language Process, IEEE Transactions on Nov. 2009 vol. 17, Issue 8 pp. 1483-1497.

Nikunen et al. "Object-based Audio Coding Using Non-negative Matrix Factorization for the Spectrogram Representation" Audio Engineering Society Convention Paper 8083, 128th Convention, London UK, May 22-25, 2010.

Smyth et al. "DTS Coherent Acoustics Delivering High-Quality Multichannel Sound to the Consumer" Audio Engineering Society 100th Convention, Copenhagen, May 11-14, 1996, pp. 4293-4314.

Website: http://www.dolby.com/uploadedFiles/zz-_Shared_Assets/English_PDFs/professional/209_Dolby_Surround_Pro_Logic_II_Decoder_Principles_of_Operation.pdf.

International Search Report received for corresponding Patent Cooperation Treaty Application No. PCT/IB2011/050042, dated Nov. 16, 2011, 6 pages.

Peng, Wei. "Constrained Nonnegative Tensor Factorization for Clustering." 2010 Ninth International Conference on Machine Learning and Applications, IEEE, Dec. 12, 2010, pp. 954-957.

Pulkki, V., "Spatial sound reproduction with directional audio coding," J. Audio Eng. Soc., vol. 55, No. 6, Jun. 2007, pp. 503-516.

Written Opinion of the International Search Authority for corresponding PCT Application No. PCT/IB2011/050042, dated Nov. 16, 2011, 7 pages.

European Intention to Grant for Application No. EP 11 855 192.8 dated Mar. 5, 2018, 70 pages.

* cited by examiner

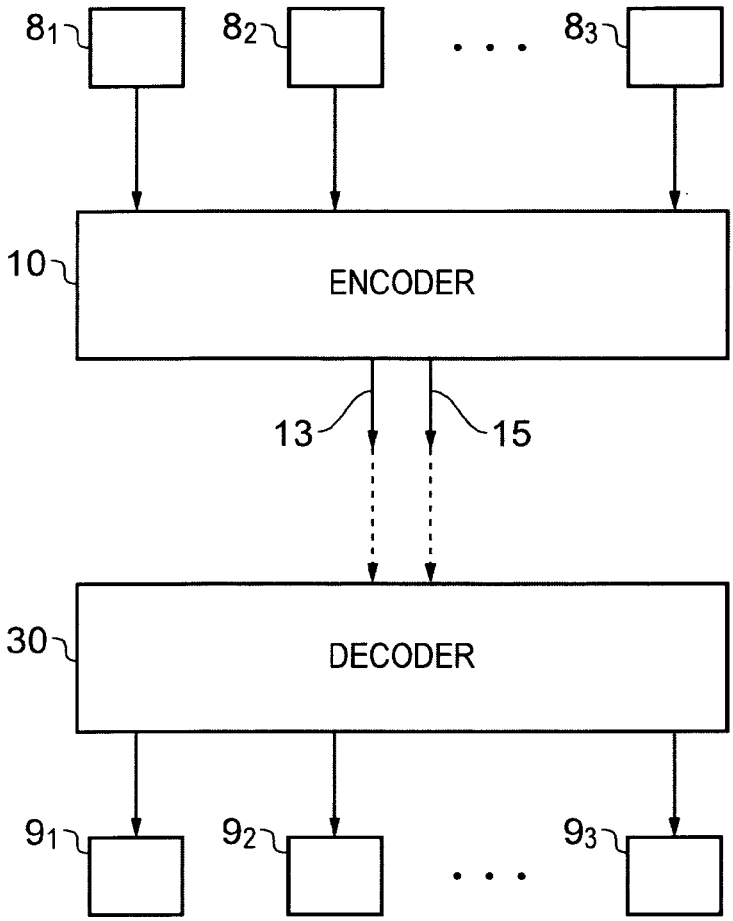
FIG. 3A
FIG. 3B
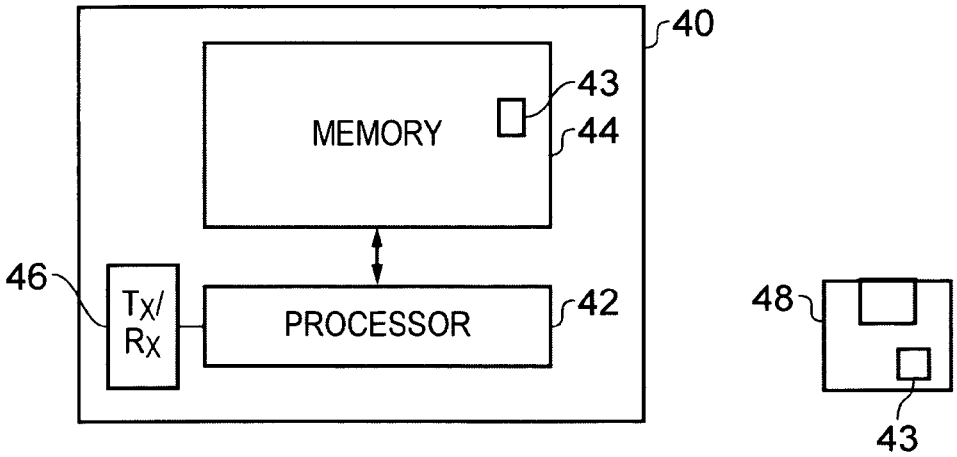
FIG. 4

MULTI-CHANNEL ENCODING AND/OR DECODING USING NON-NEGATIVE TENSOR FACTORIZATION

RELATED APPLICATION

This application was originally filed as PCT Application No. PCT/IB2011/050042 filed Jan. 5, 2011.

TECHNOLOGICAL FIELD

Embodiments of the present invention relate to multi-channel encoding and/or decoding. In particular, they relate to multi-channel audio encoding and/or decoding.

BACKGROUND

Multi-channel audio in the field of consumer electronics has been available for movies, music and games for almost two decades, and it is still increasing its popularity.

Multi-channel audio recordings have been conventionally encoded using a discrete bit stream for every channel. However, although representing multi-channel audio by discretely encoding each channel produces high quality, the amount of data that must be stored and transmitted increases as a multiple of the channels.

Some audio encoding algorithms segment a down-mix of the multi-channel audio signal into time-frequency blocks and estimate a single set of spatial audio cues for each time-frequency block. These cues are then used in the decoder to assign the time-frequency information of the down-mix to separate decoded channels.

BRIEF SUMMARY

According to various, but not necessarily all, embodiments of the invention there is provided a method comprising: receiving input signals for multiple channels; and parameterizing the received input signals into parameters defining multiple different object spectra and defining a distribution of the multiple different object spectra in the multiple channels.

According to various, but not necessarily all, embodiments of the invention there is provided a method of encoding multi-channel audio signals comprising: receiving input signals for multiple channels; transforming received input signals, from different channels, into a frequency domain; and performing non-negative tensor factorization, wherein object spectra are defined in a first tensor, time-dependent gain of the object spectra are defined in a second tensor, and channel-dependent gain of the object spectra are defined in a third tensor, According to various, but not necessarily all, embodiments of the invention there is provided a method of encoding multi-channel audio signals comprising: receiving input signals for multiple channels; transforming received input signals, from different channels, into a frequency domain; and minimizing a cost function in the frequency domain, that includes a measure of difference between a reference determined from the received input signals and an iterated estimate determined using putative parameters, wherein the putative parameters that minimize the cost function are determined as the parameters that parameterize the received input signals.

According to various, but not necessarily all, embodiments of the invention there is provided an apparatus comprising: means for receiving input signals for multiple channels; and means for parameterizing the received input signals into parameters defining multiple different object spectra and defining the distribution of the multiple different object spectra in the multiple channels.

According to various, but not necessarily all, embodiments of the invention there is provided a method comprising: receiving parameters that parameterize input signals for multiple channels by defining multiple different object spectra and a distribution of the multiple different object spectra in the multiple channels; using the received parameters to estimate signals for multiple channels.

According to various, but not necessarily all, embodiments of the invention there is provided an apparatus comprising: means for receiving parameters that parameterize input signals for multiple channels by defining multiple different object spectra and a distribution of the multiple different object spectra in the multiple channels; and means for using the received parameters to estimate signals for multiple channels. In a complex auditory scene there are many sound sources in different locations. Each of these sound sources can overlap in time and in frequency. At least some embodiments of the present invention model aspects of sound sources as object spectra that can overlap each other in time and in frequency and can span a large number of time-frequency blocks. Since these objects occur repeatedly across time and channels, thus introducing redundancy, spatial cues (parameters) can be assigned to these object spectra (instead of to each time-frequency block). The spatial sound field may be represented by the parameters as a set of object spectra that have a certain intensity and direction in each given time instance.

A single object spectra may represent similar sound events that repeat in time or in different channels.

A certain time-frequency block may belong to several object spectra and thus several channels simultaneously.

A distribution of the multiple different object spectra in the multiple channels may be defined by a channel-gain parameter. The channel-gain parameter may model the panning of the object spectra between channels.

BRIEF DESCRIPTION

For a better understanding of various examples of embodiments of the present invention reference will now be made by way of example only to the accompanying drawings in which:

FIG. 3A illustrates an encoder system and an encoding method;

FIG. 3B illustrates a decoder system and a decoding method;

FIG. 4 illustrates an apparatus configured to operate as an encoder and/or a decoder;

DETAILED DESCRIPTION

Figure 1:
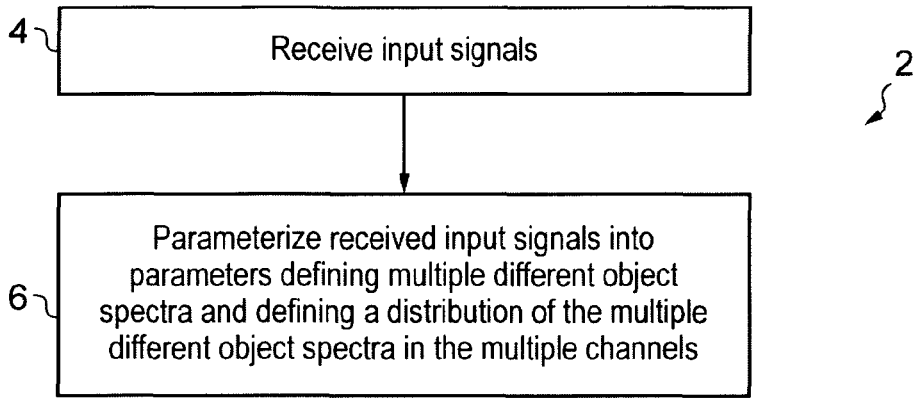
FIG. 1 illustrates an encoding method.

FIG. 1 schematically illustrates a method 2 comprising: receiving 4 input signals for multiple channels; and parameterizing 6 the received input signals into parameters defining multiple different object spectra and defining a distribution of the multiple different object spectra in the multiple channels.

Figures 2A, 2B:
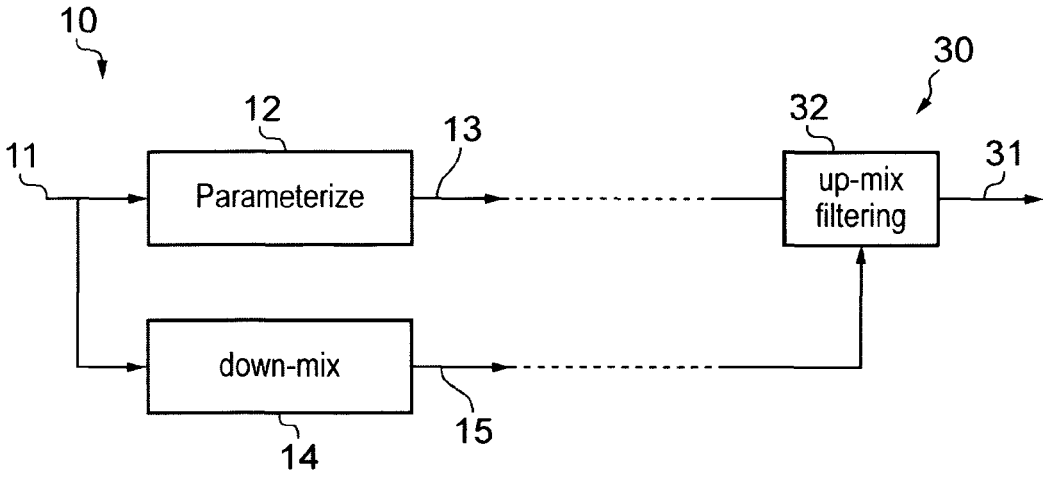
FIG. 2A illustrates an encoder and an encoding method.
FIG. 2B illustrates a decoder and a decoding method.

Referring to FIG. 2A, there is illustrated an example of an encoder 10 that performs the method 2. The method 2 is carried out in block 12. Block 12 receives input signals 11 for multiple channels and parameterizes the received input signals 11 into parameters 13. The parameters 13 define multiple different object spectra and define a distribution of the multiple different object spectra in the multiple channels.

The encoder 10, in this example, also down-mixes the input signals 11 in block 14 to form down-mixed signal(s) 15.

As illustrated in FIG. 3A, the input signals 11 for multiple channels may be audio input signals. Each channel is associated with a respective one of a plurality of audio input devices $\mathbf{8}_1, \mathbf{8}_2 \ldots \mathbf{8}_N$ (e.g. microphones) and the audio signal captured by an audio input device 8 becomes the input signal 11 for that channel. The input signals 11 are provided to an encoder 10.

A three dimensional sound field may be captured by storing the parameters 13 and the down-mixed signal(s) 15, possibly in an encoded form. The parameters 13 and the down-mixed signal(s) 15 may be output to a decoder 30 that uses them to render a three dimensional sound field.

Multiple object spectra parameterize multiple channels. Each object spectra defines variable gains over a range of frequency blocks. The object spectra potentially overlap in a frequency domain. The remaining parameters indicate how the defined object spectra repeat in time and in the channels. For example, the parameters 13 may define a first object spectra and also the distribution of the first object spectra in a first channel and also the distribution of the first object spectra in a second channel.

The object spectra characterize respective repetitive audio events. The audio events may repeat over time and/or repeat over the different channels.

The parameters 13 define object spectra and object spectra gains. The object spectra gains define the distribution of the multiple different object spectra across time (time-dependent gains) and across the multiple channels (channel-dependent gains). The channel-dependent gains may be fixed for each object but vary across channels.

Referring back to FIG. 2A, the block 12, in this example, is configured to identify object spectra that best match the transformed input signals and time-dependent and channel-dependent gains of the identified object spectra.

This may, for example, be achieved by minimizing a cost function, that includes a measure of difference between a reference determined from the received input signals 11 and an estimate determined using putative parameters. The putative parameters that minimize the cost function are determined as the parameters that parameterize the received input signals 11.

An example of a suitable cost function is described below with reference to Equation (2) or (9).

FIG. 2B illustrates a decoder 30. The decoder 30 may, for example, be separated from the encoder 10 by a communications channel such as, for example, a wireless communications channel. The decoder 30 receives the parameters 13 that parameterize the input signals 11 for multiple channels. The decoder 30 receives the down-mixed signal(s) 15.

The parameters 13 define multiple different object spectra and a distribution of the multiple different object spectra in the multiple channels. The decoder 30 uses the received parameters 13 to estimate signals 31 for multiple channels.

The decoder, for example, may comprise a block that performs up-mix filtering on the received down-mixed signal(s) 15 to produce an up-mixed multi-channel signals 31. The filtering uses a filter dependent upon the parameters 13. For example, the parameters may set coefficients of the filter.

Figure 5A:
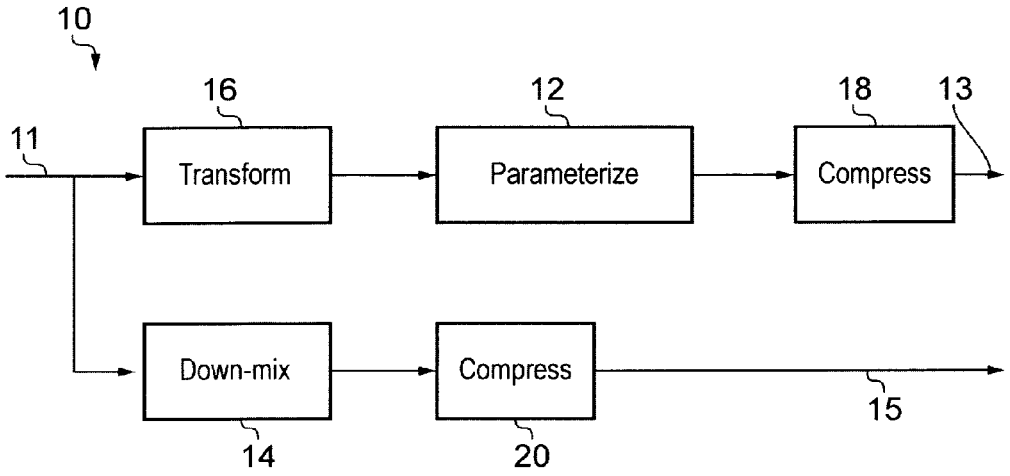
FIG. 5A illustrates an encoder and an encoding method.

As illustrated in FIG. 3B, the input signals 11 for multiple channels may be audio input signals. Each channel is associated with a respective one of a plurality of audio output devices $\mathbf{9}_1, \mathbf{9}_2 \ldots \mathbf{9}_N$ (e.g. loudspeakers). The produced up-mixed multi-channel signals 31 comprises a signal for each channel (1, 2 . . . N) and each signal is used to drive an audio output device $\mathbf{9}_1, \mathbf{9}_2 \ldots \mathbf{9}_N$ FIG. 5A illustrates an encoder 10 similar to that illustrated in FIG. 2A. However, the encoder 10 in FIG. 5A has additional blocks.

A transform block 16 transforms received input signals 11, from different channels, into a frequency domain before analysis at block 12

A parameter compression block 18 compresses the parameters 13. The compression may, for example, use an encoder such as, for example, a Huffman encoder.

A down-mix signal(s) compression block 20 compresses the down-mix signal(s). The compression may, for example, use a perceptual encoder such as an mpeg-3 encoding.

Figure 5B:
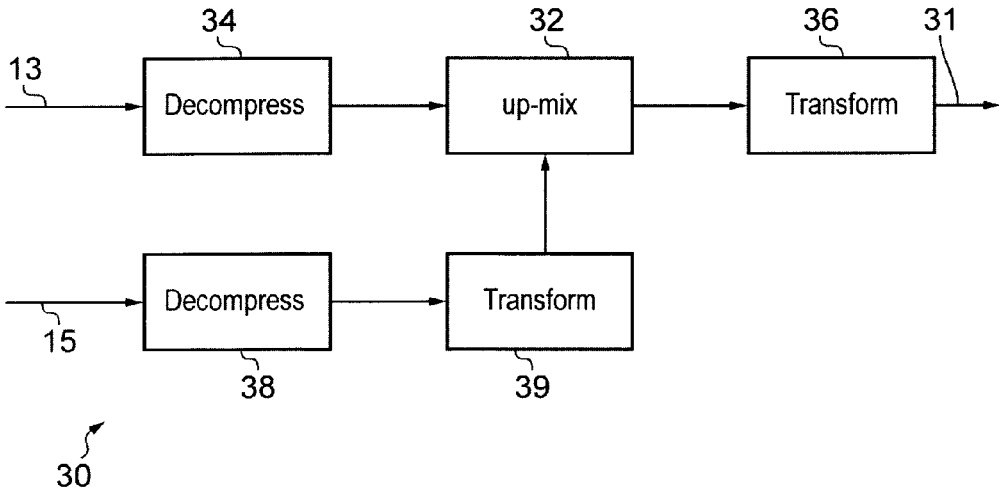
FIG. 5B illustrates a decoder and a decoding method.

FIG. 5B illustrates a decoder 30 similar to that illustrated in FIG. 2B. However, the decoder 30 in FIG. 5B has additional blocks.

A parameter decompression block 34 decompresses the compressed parameters 13. The decompression may, for example, use a decoder such as, for example, a Huffman decoder.

A down-mix signal(s) decompression block 38 decompresses the compressed down-mix signal(s) 15. The decompression may, for example, use a perceptual decoder such as mpeg-3 decoding.

A transform block 39 transforms the decompressed down-mix signals(s) 15 into the frequency domain before they are provided to the up-mixing block 32 which operates in the frequency domain.

A transform block 36 transforms the up-mixed multi-channel signals 31 from the frequency domain to the time domain.

Figure 6A:
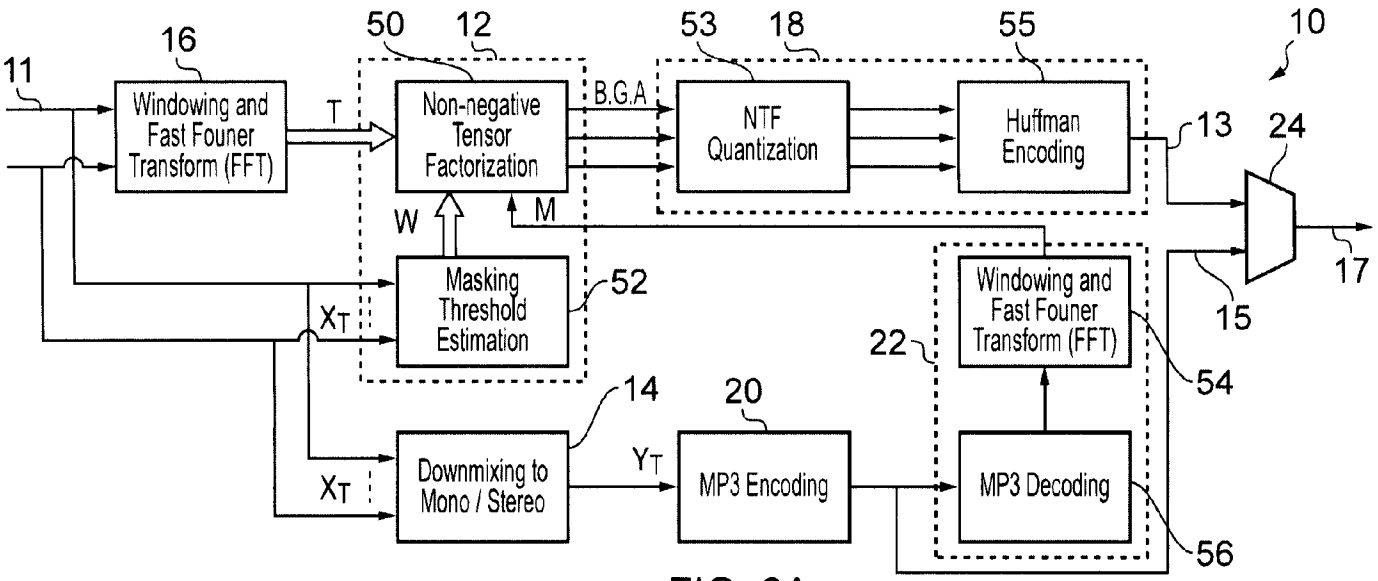
FIG. 6A illustrates an encoder and an encoding method.

FIG. 6A illustrates an encoder 10 similar to that illustrated in FIG. 5A. However, the encoder 10 in FIG. 6A has additional blocks.

At block 14 the multi-channel signal 11 is down-mixed to mono or stereo, denoted by $y_\tau$, and at block 20 it is encoded using mpeg3 or another perceptual transform coder to output the down-mixed signal 15.

Block 14 may create down-mix signal(s) as a combination of channels of the input signals. The down-mix signal is typically created as a linear combination of channels of the input signal in either the time or the frequency domain. For example in a two-channel case the down-mix may be created simply by averaging the signals in left and right channels.

There are also other means to create the down-mix signal. In one example the left and right input channels could be weighted prior to combination in such a manner that the energy of the signal is preserved. This may be useful e.g. when the signal energy on one of the channels is significantly lower than on the other channel or the energy on one of the channels is close to zero.

The transform block 16 that transforms received input signals 11, from different channels, into the frequency domain is, in this example implemented using a fast Fourier transform (FFT) or a short-time Fourier transform (STFT).

The transform block 16 divides the received input signals for each one of a plurality of channels into sequential time-blocks. Each time-block is transformed into the frequency domain. The absolute values of the transformed signals form an input magnitude spectrogram T that records magnitude relative to frequency, time, and channel. The input magnitude spectrogram is provided to block 12. The time-blocks may be of arbitrary length, they may for example, have a duration of at least one second.

Block 12 parameterizes the received input signals 11 (magnitude spectrogram T) into parameters 13. The parameters 13 define multiple different object spectra and define a distribution of the multiple different object spectra in the multiple channels.

The parameters 13 define a first tensor B representing object spectra, a second tensor G representing the time-dependent gain for each object spectra, and a third tensor A representing the channel-dependent gain for each object spectra. The tensors are second order tensors.

The block 12 performs non-negative tensor factorization, by estimating T as the tensor product of B∘G∘A.

A cost function, is defined based upon a measure of the difference between a reference tensor T determined from the received input signals in the frequency domain and an estimate B∘G∘A determined using putative parameters B, G, A. The estimate B∘G∘A is based on a tensor product of the first tensor B, the second tensor G and the third tensor A.

The putative parameters B, G, A that minimize the cost function are output by the block 12 to the compression block 18.

In this example, the block 12 may estimate an object-based approximation of the received audio signals 11 using a perceptually weighted non-negative matrix factorization (NMF) algorithm. A suitable perceptually weighted NMF algorithm gas been previously developed in J. Nikunen and T. Virtanen, "Noise-to-Mask Ratio Minimization by Weighted Non-negative Matrix factorization," in *Proceedings of IEEE International Conference on Acoustics*, Speech and Signal Processing, Dallas, USA, 2010. A NMF algorithm can be applied to any non-negative data for estimating its non-negative factors.

The frequencies defining the object spectra are assumed to have a certain direction defined by the channel configuration, and this can be accurately estimated by the NMF algorithm.

The tensor factorization model can be written as T≈B∘G∘A where operator ∘ denotes the tensor product of matrices.

where T is the magnitude spectrogram constructed of absolute values of discrete Fourier transformed (DFT) frames with positive frequencies, $B \in \mathbb{R}^{\geq 0\ K \times R}$ contains the object spectra, $G \in \mathbb{R}^{\geq 0\ R \times T}$ contains time dependent gains for each object in each time frame and $A \in \mathbb{R}^{\geq 0\ R \times C}$ contains channel-gain parameters for each object The channel-gain parameter $A_{r,c}$ denotes the absolute distribution of objects between the channels by estimating a fixed gain for each object r in each channel c to denote the distribution of objects over the time.

The number of positive discrete Fourier Transform bins is denoted by K, the number of frames extracted from the time-domain signal is denoted by T, and the number of objects used for the approximation is denoted by R.

Other possibilities exists for defining the model for approximating tensor T. One is obtained by estimating individual gains for each channel and sharing the object spectra, but since the bit rate of the model is largely dominated by the number of gain parameters, the increase of gains as a multiple of channels may not always be practical regarding the data reduction and coding efficiency.

The cost function to be minimized in finding the object-based approximation of audio signal may be the noise-to-mask ratio (NMR) as defined in T. Thiede, W. C. Treurniet, R. Bitto, C. Schmidmer, T. Sporer, J. G. Beerends, C. Colomes, M. Kheyl, G. Stoll, K. Brandenburg, and B. Feiten, "PEAQ—The ITU Standard for Objective Measurement of Perceived Audio Quality,"*Journal of the Audio Engineering Society*, vol. 48, pp. 3-29, 2000. The multiplicative updates for the perceptually weighted NMF algorithm were given in J. Nikunen and T. Virtanen, "Noise-to-Mask Ratio Minimization by Weighted Non-negative Matrix factorization," in *Proceedings of IEEE International Conference on Acoustics*, Speech and Signal Processing, Dallas, USA, 2010

The reconstruction of the tensor T can be written for each time-frequency point in each channel as sum over the objects r defined as $$T_{k,t,c} = \Sigma_{r=1}^{R} B_{k,r} G_{r,t} A_{r,c}. \tag{1}$$

The cost function to be minimized in the approximation is extended from the monoaural case and defined for multiple channels. The new cost function minimizing NMR can be written as $$NMR_L = 10 \log_{10}\left(\frac{1}{C}\sum_{c=1}^{C}\frac{1}{T}\sum_{t=1}^{T}\frac{1}{B}\sum_{k=1}^{K}[W]_{k,t,c}[T - B \circ G \circ A]_{k,t,c}^2\right), \tag{2}$$

where weighting denoted by tensor $W_{k,t,c}$ is estimated for each channel c separately.

Block 52 provides the tensor $W_{k,t,c}$ for each channel. This perceptual weighting $W_{k,t,c}$ (the masking threshold) for the NTF algorithm is estimated from the original signal prior the model formation.

The defined model minimizes the NMR measure of each channel simultaneously by updating the factorization matrices B, G and A using the following update rules $$B_{k,r} \leftarrow B_{k,r}\frac{\sum_t\sum_c (W_{k,t,c}T_{k,t,c})G_{r,t}A_{r,c}}{\sum_t\sum_c (W_{k,t,c}Y_{k,t,c})G_{r,t}A_{r,c}}, \tag{3}$$

$$G_{r,t} \leftarrow G_{r,t}\frac{\sum_k\sum_c B_{k,r}A_{r,c}(W_{k,t,c}T_{k,t,c})}{\sum_k\sum_c B_{k,r}A_{r,c}(W_{k,t,c}Y_{k,t,c})}, \tag{4}$$

$$A_{r,c} \leftarrow A_{r,c}\frac{\sum_k\sum_t B_{k,r}(W_{k,t,c}T_{k,t,c})G_{r,t}}{\sum_k\sum_t B_{k,r}(W_{k,t,c}Y_{k,t,c})G_{r,t}}, \tag{5}$$

where $Y_{k,t,c} = \Sigma_{r=1}^{R} B_{k,r} G_{r,t} A_{r,c}$ is the reconstructed approximation after each update.

This NMF estimation procedure is an iterative algorithm, which finds a set of object spectra B and corresponding gains G, A, from which the original spectrogram T is constructed.

The complete algorithm may, for example, operate as follows.

The NTF model estimation for a multi-channel audio signal is done in blocks of several seconds.

First the entries of matrices B, G and A are initialized with random values normally distributed between zero and one.

The matrices are then iteratively updated, according to update rules (3-5), to converge the approximation B∘G∘A towards the observation T according to the NMR criteria given in (2).

After each update, the rows of G are scaled to $L^2$ norm, which is compensated by scaling the columns of B. The rows of A are scaled to $L^1$ norm, and columns of B are again scaled to compensate the norm. The chosen scaling for channel-gain A ensures that the matrix product BG equals to the sum of amplitude spectra over the channels.

The NTF model is estimated for each processed time-block individually, meaning that the algorithm produces approximation T≈B∘G∘A for each time-block.

However there exists possibilities for reducing the amount of parameters to be sent to the decoder by only updating the panning parameters A and gains G, instead of updating the whole model. (see below)

The NTF signal model as described above defines constant panning of objects within each processed block.

The NTF algorithm applied to a multi-channel audio signal utilizes the inter-channel redundancy by using a single object for multiple channels when the object occurs simultaneously in the channels. The long term redundancy in audio signals is utilized similarly to the monoaural model by using a single object for repetitive sound events. The NTF algorithm automatically assigns sufficient number of objects to represent each channel, within the limits of the total number of objects used for the approximation.

The undetermined nature of reproducing T in the decoder is caused by information reduction by down-mixing of C channels to mono or stereo, and up-mixing the multiple channels by filtering the objects from the down-mixed observation. Also, possible lossy encoding of the down-mixed signal has a smaller effect. The estimation of tensor model B∘G∘A merely by approximating observation tensor T with the cost function (2) will not take into account the filtering operation used for the up-mixing. The time-frequency details of $M_{k,t}$ which are to be filtered to produce multiple channels may differ significantly from the original content of each channel of T, which the model B∘G∘A is first based on. This results to increased cross-talk between channels since time-frequency content of $M_{k,t}$ contains information from multiple channels, and therefore the filtering of non-relevant details need to be optimized in derivation of B∘G∘A. The above algorithms may therefore be adapted to take account of this.

The block 22 estimates a magnitude spectrogram $M_{k,t}$ equivalent to that determined at a decoder. The block 22 comprises a decoding block 56 and a transform block 54. The decoding block 56 decodes the encoded down-mixed signal to recover a down-mixed signal which is an estimate of a time variable decoded audio signal. The recovered down-mixed signal is then transformed by transform block 54 from the time domain to the frequency domain forming $M_{k,t}$.

The cost function is now defined as $$NMR_L = 10\log_{10}\left[\frac{1}{C}\sum_{c=1}^{C}\frac{1}{T}\sum_{t=1}^{T}\frac{1}{B}\sum_{k=1}^{K}[W]_{k,t,c}\left([T]_{k,t,c}-\frac{[B\circ G\circ A]_{k,t,c}}{[BG']_{k,t,c}}[M']_{k,t,c}\right)^2\right], \quad (9)$$

where matrices $M_{k,t}$ and $[BG]_{k,t}$ are now duplicated along dimension c to correspond to the tensor dimensions. The definitions can be written for the mono down-mix filtering as $$[M']_{k,t,c}=[M]_{k,t},[BG']_{k,t,c}=\sqrt{\Sigma_{i=1}^{C}p_i(\Sigma_{r=1}^{R}B_{k,r}G_{r,t}A_{r,t})^2},c=1\ldots C. \quad (10)$$

The model is now dependent on the squared sum of power spectra and the mono down-mix spectrogram. Minimizing the cost function directly as defined in (9) would require new update rules for matrices B, G and A, but instead of developing a new algorithm we can reformulate (9) to correspond to original cost function (2). The effect of the filtering can be included in the perceptual weighting matrix $W_{k,t,c}$ by defining a new weighting as $$[W']_{k,t,c} = [W]_{k,t,c}\frac{[M']_{k,t,c}}{[BG']_{k,t,c}}, \quad (11)$$

and use the algorithm updates in equations (3-5) with the new weighting matrix $[W']_{k,t,c}$. The weighting matrix $[W']_{k,t,c}$ must be updated after each update of B, G and A, since $[BG]_{k,t}$ is changed.

Similar weighting to optimize the stereo model can be derived by substituting $$[M']_{k,t,c}=[L]_{k,t},[BG']_{k,t,c}=\sqrt{\Sigma_{i\in L}p_i(\Sigma_{r=1}^{R}B_{k,r}G_{r,t}A_{r,i})^2},c\in L, \quad (12)$$

$$[M']_{k,t,c}=[R]_{k,t},[BG']_{k,t,c}=\sqrt{\Sigma_{i\in R}p_i(\Sigma_{r=1}^{R}B_{k,r}G_{r,t}A_{r,i})^2},c\in R, \quad (13)$$

in equations (9) and (11).

The NTF optimization model is initialized with matrices B, G and A which are derived by directly approximating the original multi-channel magnitude spectrogram. The optimization stage takes into account that not every time-frequency detail of the multi-channel spectrogram is present in the down-mix signal. If such time-frequency details are missing or changed the optimization stage minimizes the error from such cases by defining the NTF model based on the filtering cost function.

In this example, the parameters 13 (B. G, A) are compressed by compression block 18. The compression block 18, in this example, comprises a quantization block 53 followed by an encoding block 55.

The parameters 13 are quantized in block 53 to enable them to be transmitted as side information with the encoded down-mix signal 15.

The quantization of the entries of matrices B and G is non-uniform, which is achieved by applying a non-linear compression to the matrix entries, and using uniform quantization to the compressed values. The quantization model was proposed in J. Nikunen and T. Virtanen, "Object-based Audio Coding Using Non-negative Matrix Factorization for the Spectrogram Representation," in *Proceedings of* 128*th Audio Engineering Society Convention*, London, U.K., 2010. In this implementation, 4 bits per model parameter may be used.

The spectral parameters can be alternatively encoded by taking discrete cosine transform (DCT) of them and preserving the largest DCT coefficients and quantizing the result. The resulting quantized representation can be further run-length coded. This also results to preserving of rough shape of the object spectra. With longer spectra bases for the objects in time the described DCT based quantization resembles methods used in image compression.

The bit rate of the NTF representation depends on the amount of particles, i.e. matrix entries, produced per second. Particle rate of the NTF representation can be calculated using equation $$P = \left(F + \frac{K}{S} + \frac{C}{S}\right)R, \tag{15}$$

where P is the particle rate per second, $F=F_x/(N/2)$ is the number of frames per second (N=window length, and 50% frame overlap), K=N/2−1 is the number of positive DFT bins, C is the number of channels, S is the block length in seconds and R is the amount of objects used for NTF representation.

For long encoding block lengths, the amount of parameters caused by channel-gain (C/S*R) are low compared to the amount of gain parameters (F*R) and object spectra parameters (K/S*R).

Therefore a simple uniform quantization with higher amount of bits per particle was chosen for the quantization of the channel-gain parameters in matrix A. The number of bits used for the channel-gain parameter quantization was chosen as 6 bits, and the bit rate produced by it is still negligible compared to the bit rate caused by object spectra and gains.

Lets denote the number of bits used for quantizing B, G and A as $n_B$, $n_G$ and $n_A$ respectively. The bit rate can be calculated as $$P_{bits} = \left(Fn_G + \frac{K}{S}n_B + \frac{C}{S}n_A\right)R, \tag{16}$$

and the unit of measure is bits per second (bit/s).

The algorithm has been evaluated by expert listening test with the following parameters. Window length N=882 which equals to K=442 DFT bins of positive frequencies. The window is roughly 17 milliseconds long when $F_s$=44100 Hz. The window length and sampling frequency equals to F=100 frames per second. The channel configuration used is the standard 5.1, which equals to C=6. The block size to be processed is S=15 seconds, and the number of objects R=70. The bit depths were $n_B$=4, $n_G$=4 and $n_A$=6, which equals to the bit rate of the quantized NTF representation of $P_{bits}$=36419 bit/s. The parameters and individual bitrates are denoted in Tables 2 and 3.

TABLE 1

NTF model parameters used in evaluation of the developed algorithm.

| Parameter | |
|---|---|
| N | 882 |
| K | 442 |
| $F_s$ | 44100 |
| F | 100 |
| C | 6 |
| S | 15 |
| R | 70 |

TABLE 2

Individual bitrates of the NTF model parameters.

| | Object spectra | Gains | Channel-gain |
|---|---|---|---|
| Formula | (K/S * R) * $n_B$ | (F * R) * $n_G$ | (C/S * R) * $n_A$ |
| Bit rate | 8251 bit/s | 2800 bit/s | 168 bit/s |

At block 55, the bit rate of the quantized model parameters 13 can be further decreased by entropy coding scheme, such as Huffman coding.

The encoded down-mix signal 15 is combined at multiplexer 24 with the parameters 13 and transmitted.

Figure 6B:
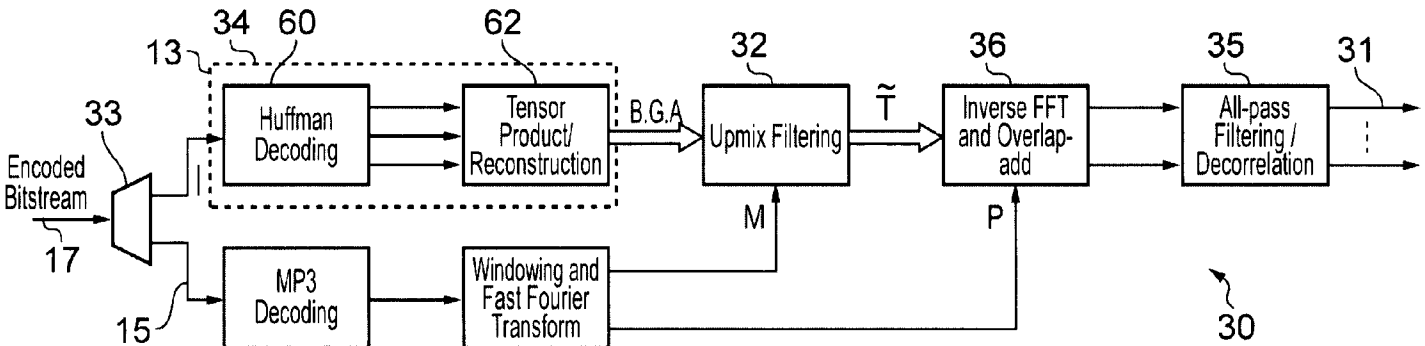
FIG. 6B illustrates a decoder and a decoding method.

Referring to FIG. 6B, the tensors B, G, A are used in a time-frequency domain filter, at block 32, for recovering separate channels from the down-mixed mono or stereo signal 15. This allows use of the phase information from the down-mixed signal 15. The tensor B, G, A are used to define which time-frequency characteristics of the down-mix signal 15 are assigned to the up-mixed channels 31.

The down-mix signal 15 is assumed to contain all significant time-frequency information from the original multiple channels, and it is then filtered (in the frequency domain) using the NTF representation B○G○A with the individual channels reconstructed. The NTF representation denotes which time-frequency details are chosen from the down-mixed signal 15 to represent the original content of each channel.

At block 36, the time-domain signals are synthesized by using the phases $P_{k,t}$ obtained from the time-frequency analysis of the down-mix signal 15 for every up-mixed channel at block 39.

As a final step, at block 35, an all-pass filtering is applied to each up-mixed channel to de-correlate the equal phases caused by using phase information from the analysis of mono or stereo down-mix.

In the decoding procedure the recovery of the multichannel signal starts by calculating the magnitude spectrogram $M_{k,t}$ of the down-mixed signal by decoding the encoded down-mixed signal 15 in block 38 and then transforming the recovered down-mix signal to the frequency domain using block 39.

The parameters 13 are decompressed at block 34. This may involve Huffman decoding at block 60, followed by tensor reconstruction which undoes the quantization performed by block 53 in the encoder 10. The decompressed parameters B, G, A are then provided to the up-mix block 32.

The filter operation performing the up-mixing at block 32 can be written for the down-mixed mono signal $M_{k,t}$ as $$T_{k,t,c} = \frac{\sum_{r=1}^{R} B_{k,r}G_{r,t}A_{r,c}}{\sqrt{\sum_{t-1}^{C} p_i\left(\sum_{r-1}^{R} B_{k,r}G_{r,t}A_{r,i}\right)^2}} M_{k,t},\ c = 1 \ldots C, \tag{6}$$

where $M_{k,t}$ consists of absolute values of DFTs of windowed frames of the down-mix, the divisor is the squared sum over the power spectra of all NTF approximation channels and $p_i$ denotes the gain for each channel used for constructing the down-mixed mono signal. The filtering as defined above takes into account that the NTF model is an approximation of the original tensor and the magnitude spectra values of the approximation are corrected by the magnitude values from the Fourier transformed down-mix signal $M_{k,t}$. This also allows using a low number of objects for the NTF approximation, since it is only used for filtering the down-mix.

The filtering can be similarly written for a down-mixed stereo signal as $$T_{k,t,c} = \frac{\sum_{r=1}^{R} B_{k,r} G_{r,t} A_{r,c}}{\sqrt{\sum_{i \in L} p_i \left( \sum_{r=1}^{R} B_{k,r} G_{r,t} A_{r,i} \right)^2}} L_{k,t}, \quad c \in L, \tag{7}$$

$$T_{k,t,c} = \frac{\sum_{r=1}^{R} B_{k,r} G_{r,t} A_{r,c}}{\sqrt{\sum_{i \in R} p_i \left( \sum_{r=1}^{R} B_{k,r} G_{r,t} A_{r,i} \right)^2}} R_{k,t}, \quad c \in R, \tag{8}$$

where $L_{k,t}$ and $R_{k,t}$ are the Fourier transformed left and right channel down-mix signal respectively. Divisor is now constructed of the squared sum of the power spectra corresponding to the left or right channel down-mix and $p_i$ denotes the gain for each such channel used in down-mixing.

After the filtering, the phase information is needed for the obtained multi-channel magnitude spectra for the synthesis of the time-domain signal by block 36. The up-mixing approach transmits the encoded down-mix and the phases of it can be extracted when DFT is applied to it for the up-mix filtering. The analysis parameters, i.e. window function and window size must be equal to the analysis of the multi-channel signal. This allows us to use the phases of the down-mixed signal in the time-domain signal reconstruction, at block 36, by assigning the phase spectrogram $P_{k,t}$ of the down-mixed signal to each up-mixed channel.

Using same phase spectrogram for each up-mixed channel in the synthesis stage makes the sound field localize inside the head despite the different amplitude panning of channels by the proposed up-mixing. A solution to this is to randomize the phase content of each up-mixed channel by filtering, at block 35, with all-pass filters having a different group delay for every channel. Applying of the all-pass filtering can be described as $$Y(z) = (1-b)z^{-P}X(z) + b[D(z)X(z)], \tag{14}$$

$$D(z) = \frac{a + z^{-P}}{1 + a z^{-P}},$$

where D(z) is the transfer function of the all-pass filter, X(z) is one of the up-mixed channels, and Y(z) is output of the filtering. Parameter b defines the mixing of the delayed original and filtered signal, and a and P are the parameters defining the all-pass filter properties, which are different for each channel. The original signal is delayed by the amount of the average group delay of the all-pass filter. In testing of the algorithm parameters given in Table 1 were used for the all pass de-correlation, b=1 for mono and b=0.9 for stereo. Other sets of parameters have also been experimented.

TABLE 3

All pass de-correlation filtering parameters for standard 5.1 channel configuration used in algorithm testing and evaluation.

| Channel | P | a |
|---|---|---|
| Front Left | 150 | 0.3 |
| Front Right | 150 | −0.3 |
| Center | 160 | 0.1 |
| LFE | 160 | −0.1 |
| Rear Left | 170 | 0.6 |
| Rear Right | 170 | −0.6 |

As previously described with reference to block 12 (FIG. 6A), there exists possibilities for reducing the amount of parameters to be sent to the decoder by only updating the panning parameters A and gains G, instead of updating the whole model.

The block 12 may have a first mode of operation as previously described in which the object spectra B are variable and are determined along with the other parameters (time-dependent gain G and channel-dependent gain A).

The block 12 may have a second mode of operation in which the object spectra B are held constant while the other parameters (time-dependent gain G and channel-dependent gain A) are determined. For example, the object spectra B may be held constant for successive time blocks. The received input signals 11 may be parameterized into parameters 13 as previously described with the additional constraint that the object spectra B remain constant. The analysis consequently defines, for each block, the distribution of the constant multiple different object spectra in the multiple channels (A) and the distribution of the constant multiple different object spectra over time (G).

It may be that the block 12 may switch between the first mode and the second mode.

For example, for certain periods, the first mode may occur every N time blocks and the second mode could occur otherwise. The minority first mode would regularly interleave the second mode.

As another example, the block 12 may initially in the first mode and then switch to the second mode. It may then remain in the second mode until a first trigger event causes the mode to switch from the second mode to the first mode. The block 12 may then either automatically subsequently return to the second mode or may return when a second trigger event occurs.

FIG. 4 illustrates an apparatus 40 that may be an encoder apparatus, a decoder apparatus or an encoder/decoder apparatus.

An apparatus 40 may be an encoder apparatus comprising means for performing any of the methods described with references to FIGS. 1, 2A, 3A, 5A, 6A.

An apparatus 40 may be a decoder apparatus comprising means for performing any of the methods described with references to FIG. 2B, 3B, 5B or 6B.

An apparatus 40 may be an encoder/decoder apparatus comprising means for performing any of the methods described with references to FIGS. 1, 2A, 3A, 5A, 6A and comprising means for performing any of the methods described with references to FIG. 2B, 3B, 5B or 6B.

Implementation of encoder and/or decoder functionality can be in hardware alone (a circuit, a processor . . . ), have certain aspects in software including firmware alone or can be a combination of hardware and software (including firmware).

The encoder and/or decoder functionality may be implemented using instructions that enable hardware functionality, for example, by using executable computer program instructions in a general-purpose or special-purpose processor that may be stored on a computer readable storage medium (disk, memory etc) to be executed by such a processor.

In FIG. 4, a processor 42 is configured to read from and write to the memory 44. The processor 42 may also comprise an output interface via which data and/or commands are output by the processor 42 and an input interface via which data and/or commands are input to the processor 42.

The memory 44 stores a computer program 43 comprising computer program instructions that control the operation of the apparatus 40 when loaded into the processor 42. The computer program instructions 43 provide the logic and routines that enables the apparatus to perform the methods illustrated in the Figures. The processor 42 by reading the memory 44 is able to load and execute the computer program 43.

Consequently, the apparatus 40 comprises at least one processor 42; and at least one memory 44 including computer program code 43. The at least one memory 44 and the computer program code 43 are configured to, with the at least one processor 42, cause the apparatus 30 at least to perform the method described with reference to any of FIGS. 1, 2A, 3A, 5A, 6A and/or FIG. 2B, 3B, 5B or 6B.

The apparatus 40 may be sized and configured to be used as a hand-held device. A hand-portable device is a device that can be geld within the palm of a hand and is sized to fit in a shirt or jacket pocket.

The apparatus 40 may comprise a wireless transceiver 46 is configured to transmit wirelessly parameterized input signals for multiple channels. The parameterized input signals comprise the parameters 13 (with or without compression) and the down-mix signal 15 (with or without compression).

The computer program may arrive at the apparatus 40 via any suitable delivery mechanism 48. The delivery mechanism 48 may be, for example, a computer-readable storage medium, a computer program product, a memory device, a record medium such as a compact disc read-only memory (CD-ROM) or digital versatile disc (DVD), an article of manufacture that tangibly embodies the computer program 43. The delivery mechanism may be a signal configured to reliably transfer the computer program 43. The apparatus 40 may propagate or transmit the computer program 43 as a computer data signal.

Although the memory 44 is illustrated as a single component it may be implemented as one or more separate components some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term 'circuitry' refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device."

As used here 'module' refers to a unit or apparatus that excludes certain parts/components that would be added by an end manufacturer or a user. The apparatus 40 may be a module.

The blocks illustrated in the FIGS. 1, 2A, 2B, 3A, 3B, 5A, 5B, 6A, 6B may represent steps in a method and/or sections of code in the computer program 43. The illustration of a particular order to the blocks does not necessarily imply that there is a required or preferred order for the blocks and the order and arrangement of the block may be varied. Furthermore, it may be possible for some blocks to be omitted.

Although embodiments of the present invention have been described in the preceding paragraphs with reference to various examples, it should be appreciated that modifications to the examples given can be made without departing from the scope of the invention as claimed. For example, in FIGS. 5A and 6A, the down-mixing of the input signals 11 is illustrated as occurring in the time domain, in other embodiments it may occur in the frequency domain. For example, the input to block 14 may instead come from the output of block 16. If down-mixing occurs in the frequency domain, then the transform block 39 in the encoder is not required as the signal is already in the frequency domain.

FIG. 1 schematically parameterizing 6 the received input signals into parameters defining multiple different object spectra and defining a distribution of the multiple different object spectra in the multiple channels.

In the example of FIG. 6A, block 12 parameterizes the received input signals 11 (magnitude spectrogram T) into parameters 13. The parameters 13 define a first tensor B representing object spectra, a second tensor G representing the time-dependent gain for each object spectra, and a third tensor A representing the channel-dependent gain for each object spectra. The tensors are second order tensors. The block 12 performs non-negative tensor factorization, by estimating T as the tensor product of $B \circ G \circ A$.

In another example, not illustrated, a sinusoidal codec may be used to define multiple different object spectra and define a distribution of the multiple different object spectra in the multiple channels. In sinusoidal coding objects are made of sinusoids that have a harmonic relationship to each other. Each object is defined using a parameter for the fundamental frequency (the frequency F of the first sinusoid) and the frequency and time domain envelopes of the sinusoids. The object is then a series of sinusoids having frequencies F, 2F, 3F, 4F . . . .

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A method comprising:

receiving audio signals for multiple channels, wherein each channel provides separately captured audio signals;

parameterizing the received audio signals into parameters defining multiple different object spectra, wherein the parameters comprise tensors including a first tensor representing object spectra, a second tensor representing a variation of gain for each object spectra with time, and a third tensor representing a variation of gain for each object spectra in respective channels, wherein the tensors are second order tensors, wherein each object spectra comprises a series of sinusoids based on a fundamental frequency, and wherein the object spectra are held constant, and, for successive time blocks, the received audio signals are parameterized into parameters constrained to define the constant object spectra and to define the distribution of the constant multiple different object spectra in the multiple channels, and minimizing a cost function, that includes a measure of difference between a reference determined from the received audio signals and an iterated estimate determined using putative parameters, wherein the putative parameters that minimize the cost function are determined as the parameters that parameterize the received input signals, wherein the iterated estimate is based on a tensor product, wherein the tensor product is a product of the first tensor defining the object spectra, the second tensor defining a time-dependent gain of the object spectra and the third tensor defining a channel-dependent gain of the object spectra, and wherein the iterated estimate is based on a channel-dependent weighting.

2. The method as claimed in claim 1, further comprising:

transforming received input signals, from different channels, into a frequency domain and analyzing the transformed input signals to identify a plurality of object spectra; and identifying object spectra that best match the transformed input signals and time-dependent and channel-dependent gains of the identified object spectra.

3. The method as claimed in claim 1, further comprising performing non-negative tensor factorization, wherein object spectra are defined in the first tensor, time-dependent gain of the object spectra are defined in the second tensor, and channel-dependent gain of the object spectra are defined in the third tensor.

4. The method as claimed in claim 1, wherein the estimate is based on a weighting dependent upon an estimate of a time variable signal used in decoding after transformation to a frequency domain, and wherein the time variable signal is a down mixed input signal or signals, encoded and then decoded, wherein encoded down-mixed signals and the parameters define encoded input signals.

5. The method as claimed in claim 1, wherein the object spectra are variable, and the received input signals are parameterized into parameters defining multiple different object spectra and defining the distribution of the multiple different object spectra in the multiple channels.

6. An apparatus comprising at least one processor and at least one memory including computer program code, the at least one memory and the computer program code configured to, with the at least one processor, cause the apparatus to:

receive audio signals for multiple channels, wherein each channel provides separately captured audio signals;

parameterize the received audio signals into parameters defining multiple different object spectra and defining a distribution of the multiple different object spectra in the multiple channels, wherein the parameters comprise tensors including a first tensor representing object spectra, a second tensor representing a variation of gain for each object spectra with time, and a third tensor representing a variation of gain for each object spectra in respective channels, wherein the tensors are second order tensors, wherein each object spectra comprises a series of sinusoids based on a fundamental frequency, and wherein the object spectra are held constant, and, for successive time blocks, the received audio signals are parameterized into parameters constrained to define the constant object spectra and to define the distribution of the constant multiple different object spectra in the multiple channels, and minimize a cost function, that includes a measure of difference between a reference determined from the received input signals and an iterated estimate determined using putative parameters, wherein the putative parameters that minimize the cost function are determined as the parameters that parameterize the received audio signals, wherein the estimate is based on a tensor product, wherein the tensor product is a product of the first tensor defining the object spectra, the second tensor defining a time-dependent gain of the object spectra and the third tensor defining a channel-dependent gain of the object spectra, and wherein the estimate is based on a channel-dependent weighting.

7. The apparatus as claimed in claim 6, wherein the apparatus is further caused to:

transform received input signals, from different channels, into a frequency domain and analyzing the transformed input signals to identify a plurality of object spectra; and identify object spectra that best match the transformed input signals and time-dependent and channel-dependent gains of the identified object spectra.

8. The apparatus as claimed in claim 6, wherein the apparatus is further caused to perform non-negative tensor factorization, wherein object spectra are defined in the first tensor, time-dependent gain of the object spectra are defined in the second tensor, and channel-dependent gain of the object spectra are defined in the third tensor.

9. The apparatus as claimed in claim 6, wherein the object spectra are variable, and the received input signals are parameterized into parameters defining multiple different object spectra and defining the distribution of the multiple different object spectra in the multiple channels.

10. The apparatus as claimed in claim 6, wherein the estimate is based on a weighting dependent upon an estimate of a time variable signal used in decoding after transformation to a frequency domain, wherein the time variable signal is a down mixed input signal or signals, encoded and then decoded, and wherein encoded down-mixed signals and the parameters define encoded input signals.

* * * * *